United States Patent [19]

Enyart et al.

[11] 4,351,137

[45] Sep. 28, 1982

[54] PLASTIC PANEL MOUNTING FRAME

[75] Inventors: Charles E. Enyart; John E. Shoulis, both of Dallas, Tex.

[73] Assignee: Baxt Industries, Inc., Addison, Tex.

[21] Appl. No.: 113,730

[22] Filed: Jan. 21, 1980

[51] Int. Cl.[3] ..... E06B 3/28; E04C 2/38; E04C 2/54

[52] U.S. Cl. ..... 52/202; 52/824

[58] Field of Search ..... 52/202, 824, 464, 468, 52/395

[56] References Cited

U.S. PATENT DOCUMENTS

| | | | |
|---|---|---|---|
| 2,073,278 | 3/1937 | Hohl | 52/395 X |
| 3,303,626 | 2/1967 | Brigham | 52/824 X |
| 3,553,915 | 1/1971 | Passovoy | 52/468 X |
| 3,732,659 | 5/1973 | La Barge | 52/464 X |
| 4,069,641 | 1/1978 | De Zutter | 52/202 |

*Primary Examiner*—Alfred C. Perham
*Attorney, Agent, or Firm*—Kenneth R. Glaser

[57] ABSTRACT

An improved panel mounting molding for framing interior storm windows of the type including a base adhesively secured to a window frame and an interlocking pane biasing strip for holding an insulating window pane against the base. Improvements include a biasing strip anchoring arrangement comprising a channel formed on said base in which the inside channel walls each carry three opposed ridges and a corresponding anchor on the biasing strip having three corresponding grooves for mating with the ridges in the anchoring channel. The biasing strip may be anchored to the base in at least two different positions providing a wide range of useful pane thicknesses.

3 Claims, 4 Drawing Figures

PLASTIC PANEL MOUNTING FRAME

BACKGROUND OF THE INVENTION

The present invention relates to insulating windows or storm windows for interior use and more particularly to improve extruded plastic panel molding for forming and mounting interior insulating windows.

The usefulness of storm windows is generally well known. Energy shortages and rising costs of heating and coolinghave increased the use of storm windows since they can greatly reduce heat loss. As an alternate to the expensive permanent exterior storm windows, the use of a simple additional pane attached to interior window frames has been found quite effective and economical. References specifically illustrating such uses include U.S. Pat. Nos. 4,069,641 issued to DeZutter and 3,939,620 issued to Bero. Other references illustrating similar panel mounting or framing elements include U.S. Pat. Nos. 3,455,080 issued to Meadows and 3,360,893 issued to Wattelez. The first two of these patents, DeZutter and Bero, most clearly illustrate the field of the present invention. Each involves the use of a panel frame which is adhesively to an interior window frame and which provides some means for retaining the edges of an insulating window pane. DeZutter teaches a snap-in retaining leaf for the window pane while Bero teaches a retaining portion hinged to the base which snaps into engagement with the base. The device taught by Meadows, while not being designed for adhesively mounting to a window frame, provides other features including essentially fluid-tight-sealing soft ribs on the frame and a leaf retaining arrangement for accommodating panes of different thickness. The Wettelez device is another hinged frame member and is arranged for nailing to a window frame.

While the Meadows type frame provides an essentially fluid tight seal and provides some allowance for various pane thickness, the structure is relatively complicated, both in shape and in the requirement of dual extrusion of different materials. The simpler, more practical frames as taught in particular by DeZutter, on the other hand provide a less fluid tight seal and less positive mechanical link between the pane retaining leaf and the base member.

It can be seen therefore that a simple single material extruded plastic insulating window frame having improved anchoring of a pane retaining leaf which is also useful for panes having a variety of thicknesses would be desirable.

SUMMARY OF THE INVENTION

Accordingly, an object of the present invention, is to provide an improved panel mounting frame member for use with interior insulating windows.

Another object of the present invention is to provide a panel mounting molding having improved anchoring means between a pane retaining leaf and a base portion.

Another object of the present invention is to provide a panel mounting molding having an adjustable spacing between a pane biasing strip and a base portion to thereby allow use with window panes of varying thickness.

These and other objects of the present invention are achieved by providing a two part panel mounting molding comprising a base portion including an anchoring channel carrying three pairs of opposing ridges and a pane retaining leaf portion having an anchor for mating with the channel in the base portion wherein the anchor has three pairs of opposing grooves corresponding to the ridges in the anchoring channel. The ridges and the grooves are appropriately spaced to interlock in at least two different positions thereby accommodating window panes of different thicknesses.

BRIEF DESCRIPTION OF THE DRAWINGS

The present invention may be better understood by reading the following detailed description of the preferred embodiment with reference to the accompanying drawings wherein.

DESCRIPTION OF THE PREFERRED EMBODIMENT

Figure 1:
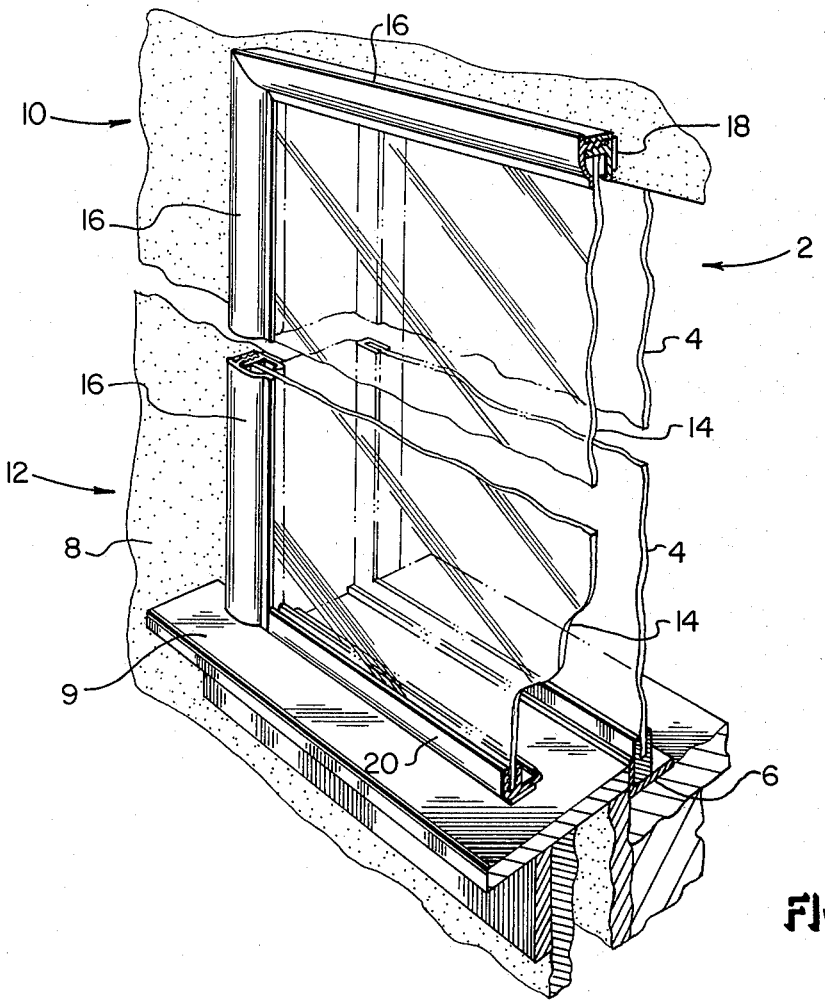
FIG. 1 is a perspective view of portions of a framed insulating window installed according to the preferred embodiment.

With reference now to FIG. 1, there is illustrated in cutaway perspective view upper and lower corners 10 and 12 respectively, of an assembled and installed insulating window according to the present invention. The overall assembly illustrated in FIG. 1 is generally the same as that previously known and used and is shown installed over a conventional window 2. The window 2 includes glass panes 4 mounted in a permanent frame 6 which is in turn attached to an opening in a wall 8. A sill 9 is typically provided at the bottom of the opening and extends to the interior of wall 8. The surface of wall 8 surrounding the window 2 is commonly considered part of the window frame and will be treated as such herein. A typical interior insulating window 14 comprises an approximately ⅛ inch thick sheet of transparent styrene plastic. This material is typically preferred because of its low cost, good insulating qualities and shatter resistant properties. A standard glass pane could of course be used but would generally cost more and would be more difficult to handle. The pane 14 is framed on its top and sides by a framing and mounting molding 16 which is secured to the window frame by means of an adhesive strip 18 in known fashion. The lower edge of pane 14 is supported by a strip of base portion 20 of the molding 16 when, as illustrated in FIG. 1, the window includes a bottom sill 9 extending to the interior of the wall surface. In the event a window did not have such a lower sill, the lower edge of frame 14 would be supported in the same manner as illustrated for the top and side.

Figure 2:
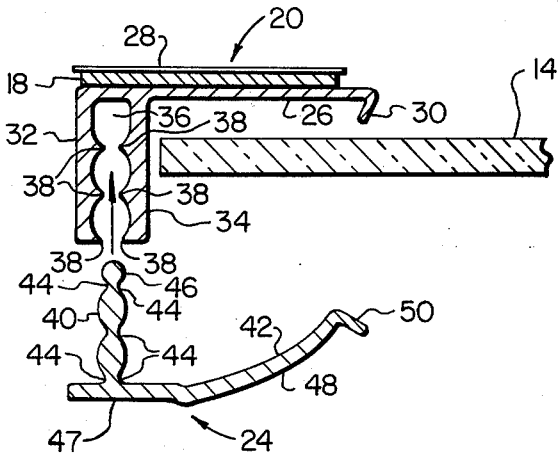
FIG. 2 is a cross section illustration of the panel mounting components according to the present invention in unassembled form showing their relationship to a window pane and, FIG. 3 and FIG. 4 are cross sectional illustrations of the panel mounting molding according to the present invention assembled and installed in two positions accommodating two different window pane thicknesses.

With reference now to FIG. 2, the panel molding of the present invention is illustrated in cross sectional view separated into its two parts but positioned ready for assembly with a pane 14. Like designation numbers are used to indicate parts also illustrated in FIG. 1. The entire panel mounting molding comprises a base portion 20 and a pane retaining leaf portion 24. The base portion 20 includes a flat web 26 having in preferred form a resilient adhesive strip 18 attached to one surface. The strip 18 is a commercial product and is supplied with an adhesive protecting strip 28 such as wax paper or thin plastic. The strip 28 is removed to expose the adhesive and allow the base portion 20 to be secured to a wall or window sill. The opposite side of web 26 carries along one edge an upstanding flange or ridge 30 for supporting the pane 14. The supporting flange 30 increases the structural strength of the edge of web 26 and is aligned with an edge of the retaining leaf 24 to grip the pane 14 securely. As illustrated the flange 30 extends at almost a right angle from the web 26, but is slightly curved and in fact forms part of an almost continuous curve which includes a portion of the leaf 24. On a second edge of web 26, also opposite the adhesive 28, there is provided a large upstanding boss comprising two flanges 32 and 34 closely spaced and forming a channel 36 therebetween. Three pairs of ridges 38 are carried on the interior opposing faces of flanges 32 and 34. The outermost of the ridges 38 are carried adjacent to the open edge of the channel 36 with the other two pairs being essentially equally spaced along the depth of the channel 36. The flanges 32 and 34 extend at essentially right angles from the web 26.

The pane biasing strip 24 comprises an anchor portion 40 and a biasing leaf 42. The anchor 40 is primarily designed for snapping into the channel 36 in the base portion. This anchor 40, therefore is primarily of rectangular shape but has three pairs of grooves 44 corresponding to the three pairs of ridges 38 carried within channel 36. In addition a leading edge 46 of the anchor 40 is somewhat narrower than the remaining portions of the anchor to aid in insertion of the anchor into the channel 36. The pane retaining leaf 42 comprises a first essentially straight section 47 extending at right angles from one end of anchor 40 and a curved portion 48 extending from one edge of the straight portion 47 and having an upturned flange 50 along an edge opposite the straight portion 46. In preferred form the curved portion 48 forms a somewhat continuous curve with the flange 30 along the base 20. This provides a pleasing appearance when the overall molding strip is assembled and the upturned edge 50 is positioned over the flange 30.

Figure 3:
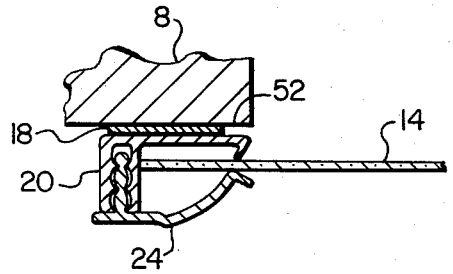

FIG. 3 illustrates the molding strip 16 assembled together with the pane 14 and secured by the adhesive strip 18 to a window facing 52. In this FIG. 3 embodiment, the window pane 14 has a nominal thickness of $\frac{1}{8}$ inch but may be smaller or even slightly larger. To accommodate this nominal pane thickness, the anchor 40 of the pane retaining strip 24 is inserted all the way in the channel 36 so that each of the pairs of ridges 38 in channel 36 engages a groove 44 in the anchor 40. When thus assembled, it can be seen that the flanges 50 and 30 are approximately aligned and the curved portion 48 of leaf 42 forms a pleasing continuous surface with the pane supporting flange 30. In addition, it can be seen that with the triple interlock of three pairs of ridges 38 with three pairs of grooves 44 a very secure anchoring of the strip to the base 20 is achieved.

Figure 4:
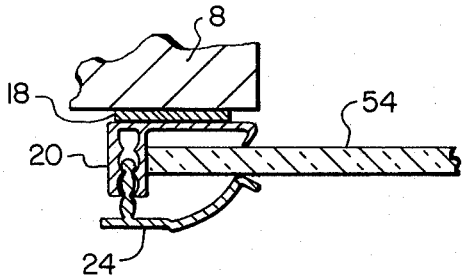

With reference to FIG. 4, there is illustrated an alternate assembly or position of the pane retaining strip 24 with respect to the base 20. In FIG. 4 a window pane 54 has a nominal $\frac{1}{4}$ inch thickness although any thickness from about $\frac{1}{4}$ to slightly more than $\frac{1}{4}$ inch can be accommodated by the illustrated positioning of the pane retaining strip 24 with respect to the base 20. This FIG. 4 arrangement is achieved by merely inserting the anchor 40 only part way in the channel 36 so that only two pairs of ridges 38 engage two of the grooves 44. While this engagement of two pairs of ridges and grooves provides less anchoring force than that illustrated in FIG. 3, it clearly provides greater anchoring force than can be provided by a single anchoring element previously used in simple pane mounting molding strips.

It is apparent that the present panel mounting molding strip can also be assembled so that only a single pair of ridges interlocks with a single pair of grooves and greater pane thicknesses could thereby be accommodated. Such an arrangement is not preferred because there appear to be few practical applications for panes thicker than $\frac{1}{4}$ inch. If this single interlock arrangement is used the leading edge 46 would preferably be made at least as thick as the rest of anchor 40.

With reference back to FIG. 1, it can be seen that in a typical installation employing the present panel mounting molding the molding is cut in a miter box to form close fitting corners and thereby improve the air-tightness. In FIG. 1, the bottom of the side window molding 16 is cut at a right angle because the illustrated window includes an extended window sill 9. In this case it is preferred to use the base portion 20 as the only pane mounting molding for the sill edge. As shown in FIG. 1, this is accomplished by simply inserting a pane 14 into the channel 36 and then employing adhesive strip 18 to secure the base 20 to the window sill. No leaf portion 24 is employed for this sill portion. The dimensions of channel 36 are preferabley appropriate for receiving and tightly gripping a nominal $\frac{1}{8}$ inch thick pane 18, which is the most common size for the interior insulating windows according to the present invention. As noted above, if the window does not have the sill 22, the bottom edge of the pane 14 may be supported in exactly the same manner as the top and sides. In addition if a thicker pane is desired or if the standard mounting arrangement illustrated in FIGS. 2, 3 and 4 is also desired for the window sill a slightly different arrangement of the adhesive strip 18 may be employed. That is, if the adhesive strip 18 is applied to the outer flat surface of the flange 32, the base portion 20 can be mounted to a window sill to thereby accommodate a pane in the same manner as the top and side illustrated in FIG. 1.

An insulating window pane according to the present invention may be installed in at least two basically different ways. The molding strips may be cut to size and attached by the adhesive around a window frame on the interior of the house. The pane 14 may then be cut to fit within the base portion 20 of the frame and held in place while the pane retaining strips 24 are snapped into the channel 36. Alternatively the molding strips may be cut to fit a precut window pane and assembled onto the window pane prior to securing to the interior wall or frame around a window. The cover strips 28 would then be removed while the frame is supported by the insulating pane and the entire assembly can be set in place over a window and pressed against the wall surface to be secured tightly thereto. Other variations in assembly procedure are apparent to those skilled in the art.

While the present invention has been shown and illustrated in terms of specific apparatus and methods of assembly, it will be apparent that changes or modifications can be made without departing from the scope of the invention as defined by the appended claims.

What is claimed is:

1. In a panel mounting molding of the type comprising a base adhesively secured to a window frame and an interlocking pane biasing strip for positively holding a glazing pane against said base, the improvement comprising:

a base having an elongated rectangular web having one surface for adhesive securement to a window frame, and a second surface carrying on a first edge, an upstanding pane supporting flange and, on a second edge, an upstanding boss, said upstanding boss comprising a pair of spaced jaws, said jaws having opposed faces defining a channel having an opening opposite said web, each of said faces carrying three ridges, with said ridges positioned in three opposing pairs, the peaks of the ridges of the outermost pair of said ridges being formed to define said opening of said channel, a pane biasing strip comprising an elongated generally rectangular anchor for interlocking with said base, and a leaf extending obliquely from one edge of said anchor for holding a glazing pane against said pane supporting flange, said anchor having on each of two opposite surfaces thereof three opposing grooves corresponding to the three pairs of ridges carried by said jaws, and a leading edge of said anchor distal of the first of said pairs of said grooves having a maximum thickness less than the maximum thickness of the remaining portions of said anchor between the first and third of said pairs of said grooves whereby insertion of said anchor past said outermost pair of ridges into said channel is facilitated, said base and said biasing strip being adapted for selective interlocking in at least first and second positions, said first position being the complete insertion of said anchor into said channel and resulting in mating of all three pairs of said ridges with all three pairs of said grooves, and said second position being the partial insertion of said anchor into said channel and the mating of two of said pairs of said ridges with two of said pairs of said grooves, said leaf including a continuously curved portion, and being aligned with said pane supporting flange so that said leaf and said pane supporting flange form a substantially continuous surface in at least one of said first and second positions, and said leaf being positioned relative to said pane supporting flange to allow mounting of panes up to about $\frac{1}{8}$ inch in thickness at said first interlocking position, and panes from about $\frac{1}{8}$ to about $\frac{1}{4}$ inch in thickness at said second interlocking position.

2. The improved panel mounting molding of claim 1 further including a leaf flange carried on an edge of said leaf opposite said anchor, said leaf flange positioned at about a right angle to said leaf and turned away from said pane supporting flange of said base.

3. In a panel mounting molding of the type comprising a base adhesively secured to a window frame and an interlocking pane biasing strip for positively holding a glazing pane against said base, the improvement comprising:

a base having an elongated rectangular web having one surface for adhesive securement to a window frame, and a second surface carrying on a first edge, an upstanding pane supporting flange and, on a second edge, an upstanding boss, said upstanding boss comprising a pair of spaced jaws, said jaws having opposed faces defining a channel having an opening opposite said web, each of said faces carrying three ridges, with said ridges positioned in three opposing pairs, the peaks of the ridges of the outermost pair of said ridges defining said opening of said channel, a pane biasing strip comprising an elongated generally rectangular anchor for interlocking with said base, and a leaf extending obliquely from one edge of said anchor for holding a glazing pane against said pane supporting flange, said anchor having dimensions corresponding to said channel and having on each of two opposite surfaces thereof three opposing grooves corresponding to the three pairs of said ridges carried by said jaws, said base and said biasing strip being adapted for selective interlocking in at least first and second positions, said first position being the complete insertion of said anchor into said channel and resulting in mating of all three pairs of said ridges with all three pairs of said grooves, and said second position being the partial insertion of said anchor into said channel and the mating of two of said pairs of said ridges with two of said pairs of said grooves, a leading edge of said anchor distal of the first of said pairs of said grooves having a maximum thickness less than the maximum thickness of the remaining portions of said anchor between the first and third of said pairs of said grooves whereby insertion of said anchor into said channel and past said outermost pair of ridges is facilitated, and said leaf being positioned relative to said pane supporting flange to allow mounting of panes up to about $\frac{1}{8}$ inch in thickness at said first interlocking position, and panes from about $\frac{1}{8}$ to $\frac{1}{4}$ inch in thickness at said second interlocking position.

* * * * *